US008935813B2

(12) United States Patent
O'Leary

(10) Patent No.: US 8,935,813 B2
(45) Date of Patent: Jan. 20, 2015

(54) UNDERWEAR GARMENT

(76) Inventor: Paul O'Leary, Leicestershire (GB)

( * ) Notice: Subject to any disclaimer, the term of this patent is extended or adjusted under 35 U.S.C. 154(b) by 415 days.

(21) Appl. No.: 12/922,134

(22) PCT Filed: Mar. 11, 2009

(86) PCT No.: PCT/GB2009/000655

§ 371 (c)(1),
(2), (4) Date: Sep. 10, 2010

(87) PCT Pub. No.: WO2009/112827

PCT Pub. Date: Sep. 17, 2009

(65) Prior Publication Data

US 2011/0023216 A1 Feb. 3, 2011

(30) Foreign Application Priority Data

Mar. 12, 2008 (GB) ..... 0804538.7

(51) Int. Cl.
*A41B 9/02* (2006.01)
*A41B 9/00* (2006.01)

(52) U.S. Cl.
CPC ..... *A41B 9/001* (2013.01); *A41B 2400/36* (2013.01)
USPC ..... 2/401; 2/400

(58) Field of Classification Search
USPC ..... 2/400–407, 272, 901; 604/360, 367, 604/385.01
See application file for complete search history.

(56) References Cited

U.S. PATENT DOCUMENTS 1,784,744 A * 12/1930 Negley ..... 2/404
2,384,165 A * 9/1945 Goldfarb et al. ..... 2/404
2,435,945 A * 2/1948 Redmond ..... 2/406
3,706,103 A * 12/1972 Senser ..... 2/402
4,143,197 A * 3/1979 Jasionowicz et al. ..... 442/49
4,641,381 A * 2/1987 Heran et al. ..... 2/400
4,715,857 A * 12/1987 Juhasz et al. ..... 602/42
4,969,216 A * 11/1990 Guelli ..... 2/400
5,315,717 A * 5/1994 Moretz et al. ..... 2/400
5,379,462 A * 1/1995 Morgan et al. ..... 2/403

(Continued)

FOREIGN PATENT DOCUMENTS

CN 200938847 Y 8/2007
DE 299 13 581 U1 8/1999

(Continued)

OTHER PUBLICATIONS

Search Report for corresponding patent application No. GB0904212.8, dated Jul. 1, 2009, 4pp.

(Continued)

*Primary Examiner* — Andrew W Collins
(74) *Attorney, Agent, or Firm* — Christie, Parker & Hale, LLP

(57) ABSTRACT

An article of clothing (10) comprising: a first portion (14) shaped to cover at least part of a wearer's groin or buttock region during use and extending into a gusset region of the article, and a second portion (16) shaped to extend around a wearer's body so as to hold the article against the wearer during use. The first portion (14) comprises a carbon textile layer and a backing layer, the filter layer comprising a knitted material comprising activated carbon. The second material (16) comprises one or more textile panels adjacent said first portion (14) and having elasticity greater than the elasticity of the first portion such that the second portion conforms to the shape of the wearer's body.

15 Claims, 14 Drawing Sheets

(56) References Cited

U.S. PATENT DOCUMENTS

| | | | | |
|---|---|---|---|---|
| 5,546,607 | A * | 8/1996 | Roberts | 2/406 |
| 5,593,398 | A | 1/1997 | Weimer | |
| 5,665,081 | A | 9/1997 | Grosse | |
| 5,708,986 | A * | 1/1998 | Belardinelli | 2/406 |
| 5,974,592 | A | 11/1999 | Tabrizi | |
| 6,025,186 | A * | 2/2000 | Kirk et al. | 435/262 |
| 6,041,446 | A * | 3/2000 | Braunstein et al. | 2/400 |
| 6,061,839 | A * | 5/2000 | Smolik | 2/400 |
| 6,502,250 | B2 * | 1/2003 | Suga et al. | 2/406 |
| 6,807,685 | B1 * | 10/2004 | Hasegawa et al. | 2/406 |
| 6,848,121 | B1 * | 2/2005 | Halid | 2/400 |
| 7,062,788 | B2 | 6/2006 | Tremblay-Lutter et al. | |
| 7,107,628 | B2 * | 9/2006 | Haaga | 2/457 |
| 7,473,817 | B1 * | 1/2009 | Tanaka et al. | 604/358 |
| 7,669,248 | B2 * | 3/2010 | Toratani | 2/67 |
| 7,745,684 | B2 | 6/2010 | Huza et al. | |
| 7,934,268 | B2 * | 5/2011 | Newman | 2/79 |
| 8,051,495 | B2 * | 11/2011 | Lee | 2/54 |
| 2001/0025386 | A1 * | 10/2001 | Suga et al. | 2/406 |
| 2003/0187412 | A1 | 10/2003 | Martin | |
| 2003/0199841 | A1 * | 10/2003 | Ashton et al. | 604/385.01 |
| 2003/0229936 | A1 * | 12/2003 | Tremblay-Lutter et al. | 2/455 |
| 2004/0010841 | A1 | 1/2004 | Gilmartin | |
| 2004/0127866 | A1 * | 7/2004 | Odorzynski | 604/359 |
| 2004/0259728 | A1 * | 12/2004 | Ko | 502/417 |
| 2005/0182372 | A1 * | 8/2005 | Huza | 604/359 |
| 2006/0130532 | A1 * | 6/2006 | Chuang et al. | 66/198 |
| 2006/0191058 | A1 | 8/2006 | Huza | |
| 2007/0079427 | A1 * | 4/2007 | Herbert et al. | 2/403 |
| 2007/0144221 | A1 * | 6/2007 | Sytz | 66/171 |
| 2008/0249492 | A1 * | 10/2008 | Schmidt | 604/374 |
| 2012/0023645 | A1 * | 2/2012 | Murphy | 2/400 |

FOREIGN PATENT DOCUMENTS

| | | |
|---|---|---|
| DE | 20 2006 015 974 U1 | 4/2007 |
| JP | 2004-183188 | 7/2004 |
| KR | 10-2005-0123077 | 12/2005 |

OTHER PUBLICATIONS

International Search Report and Written Opinion for corresponding International Application PCT/GB2009/000655, mailed Aug. 31, 2009.

Examination Report for corresponding GB Application No. 0904212.8, dated Mar. 1, 2012, 4pp.

* cited by examiner

UNDERWEAR GARMENT

CROSS-REFERENCED TO RELATED APPLICATION(S)

This application is a National Phase Patent Application of International Application Number PCT/GB2009/000655, filed on Mar. 11, 2009, which claims priority of United Kingdom patent Application No. 0804538.7, filed on Mar. 12, 2008.

The present invention relates to garments and more specifically, although not exclusively, to undergarments.

A significant amount of effort has been expended into research of clothing and, in particular, the aspects of underwear garments which help to promote confidence and self-esteem within a wearer. Such research and development has typically centred on specific areas of the human body, such as the chest or legs, resulting in a number of improvements in the form and function of, for example, brassieres, corsets and stockings. It is perhaps fair to say that less effort has been generally expended in this regard to the groin region.

There are a number of problems and social stigmas associated with the groin region which can lead a person to lack confidence or otherwise feel embarrassed.

One such stigma which is a cause of concern for many people is flatulence and the associated emission of odorous gasses from the anus or other odours from the genital region, for example, some women suffer from bad odour caused from vaginal discharge, bacterial infections (such as bacterial vaginosis) and urine leakage which may be caused by weakened muscles from recent child birth. Numerous attempts have been made in the past to develop undergarments which lessen the odour caused by passing wind. Such attempts have involved the provision of modified undergarments or else an insertable filter member which can be located by a user against a conventional undergarment in the vicinity of the anus.

However previous attempts to solve this problem have resulted in undergarments or attachments therefore which are awkward or else uncomfortable to wear. The need to wear such abnormal undergarments alone can be a source of discomfort or embarrassment for the wearer. Often due to their cumbersome nature such undergarments are not inclined to fit the user well and are not easily adapted to suit a wide variety of shapes and sizes of user.

Furthermore the effectiveness of a number of earlier attempts to solve the problem of flatulence or other odours is questionable. This is often due to characteristics of the filter member which in many cases impede the flow of gas therethrough such that gas escapes from a wearer's undergarments unfiltered. Some such attempts to solve the problems involve the use of undergarments that retain the odours and as such may prevent moisture escaping from the genital or anus region which can in fact compound the problem.

It is an object of a first aspect of the present invention to provide garments which can effectively limit the odorous effect resulting from the passage of gas through the anus, or otherwise emitted from the genitalia whilst retaining a suitable degree of comfort and desirability for the wearer.

Another problem associated with the male groin region is the position and movement of the scrotum and penis or else the wearer's reproductive organs in general. There are a number of different movements which can lead to discomfort associated with the scrotum. For example, changes in a man's standing or seating position can lead to the testes becoming trapped or squashed between the legs. A feeling of discomfort is experience by many men when playing sport or exercising in general due to the constant movement of the scrotum and impact between the scrotum and legs.

Aside from such discomfort or pain, repeated impact or application of pressure to the testes can cause damage over time.

There is also the social stigma associated with the groin area due to the perceived size of a man's genitalia. It is generally considered by at least a portion of the population that relatively small genitalia are undesirable. Accordingly conventional loose or ill-fitting underwear allow a man's genitals to hang down and thus do not promote the size or shape of a man's groin region in a favourable light.

There are a number of examples of more tightly fitted underwear for men which can serve to hold a man's genitals close to the groin region of his torso. However the tension within the fabric of such underwear often serves to squash or depress the genitals into the wearer's body and can have a negative impact on the perceived size of the genitals. Furthermore, the fabric tension alone can cause pressure to be applied to the testes, which can cause discomfort to the wearer.

It is an object of a second aspect of the present invention to provide garments which offer improved support of a wearer's genitals.

According to a first aspect of the present invention there is provided an article of clothing comprising a first portion shaped to cover at least part of a wearer's groin or buttock region during use and extending into a gusset region of the article, and a second portion shaped to extend around a wearer's body so as to hold the article against the wearer during use, wherein the first portion comprises a filter layer and a backing layer, the filter layer comprising a knitted material comprising activated carbon, and wherein the second portion comprises one or more textile panels adjacent said first portion and having elasticity greater than the elasticity of the first portion such that the second portion conforms to the shape of the wearer's body.

The knitted carbon textile may be formed of jersey knit carbon fibres. By using a knitted carbon textile the underwear garment is made of a breathable fabric which allows gas, and more importantly moisture, to escape from the garment while filtering odours therefrom. The ability to allow moisture to escape is particularly important where there may be bacterial infections as bacteria growth rate is often accelerated by damp conditions.

Furthermore, the knitted carbon cloth used has a great flexibility and can stretch where as, in comparison, woven carbon cloths have little flexibility and do not readily stretch. Therefore, in comparison to garments including woven carbon cloth that can only hang or drape over the body, the knitted carbon fabric enables the present invention to provide an undergarment that can sculpt closely to the body, therefore making a very effective seal to prevent escape of odors without causing discomfort to user.

In one embodiment, the filter layer comprises a carbon textile. A carbon textile may be defined as a textile, cloth or fabric material comprising 40-50% carbon by weight or greater.

The present invention is advantageous in that the first portion provides an effective filter for gasses emanating from the wearer's anus or genitalia, whilst the second portion can conform to the contour of a wearer's body so as to inhibit passage of the gas around the first portion. Thus the majority of odour emanating from the user, be it in the form of gas or flatus from the rectum or other odours emanating from the genitalia, passes through the filter prior to escaping into the surrounding air.

According to a preferred embodiment the filter is an integral element of the proposed garment, sandwiched between additional layers of garment material, which provides further benefit in terms of filtering and de-odorising gases prior to their escape into the surrounding air. The filter may be sewn into the garment and may be sewn to the second portion.

The second portion may be of shape and elasticity to conform to the shape of a user's buttocks, inside thigh and crotch region. In one embodiment, the second portion is adapted to maintain contact with a user's skin around the perimeter of the first section.

The applicant has discovered that one primary reason for odour escaping around, rather than through a filter, is poor adherence to the wearer's body due to the shape, positioning and design of the garment and subsequently the gas is not in contact with the filter member long enough to be de-odorized. It has been found that the combined material properties and positioning of the first and second portions according to the present invention substantially overcomes this problem.

According to one embodiment, the carbon textile layer comprises 50% or more active carbon. The textile may comprise 70% or more carbon. The textile may comprise 90% or more carbon. In one embodiment the textile is formed of carbon fibres which may comprise 100% of the material. Preferably the carbon textile is sewn to the second material.

The carbon textile may result from heat treatment of a fabric having a lower carbon content prior to treatment. The heat treatment of cloth forms a porous carbon material which can serve as an active carbon filter. The carbon textile may be formed of jersey knit carbon fibres.

The carbon textile material may be formed via the heat treatment of viscose fabric. The carbon viscose may be knitted and may form a carbon jersey.

According to a preferred embodiment the filter layer comprises fabric having anti-bacterial properties. In one preferred arrangement the knitted carbon material includes yarn having anti bacterial properties, for example silver or copper yarns. In another preferred arrangement the knitted carbon material is impregnated with an antibacterial substance.

The anti bacterial material may be used in one or both of the genital or anus regions of the garment.

In one embodiment, the first portion comprises carbon textile sandwiched between opposing backing layers. Either or both of said backing layers may comprise a material used in the second portion. The first and/or second portion may comprise a knitted cloth, such as, for example, a jersey cloth.

The first portion may comprise a panel extending from a waistband towards the gusset such that the panel begins at a location above the buttocks and spans from a mid portion of one buttock to a mid portion of an opposing buttock such that the panel covers the crevice between a wearer's buttocks. The first portion may narrow towards the gusset. The first portion may pass over the anus through the gusset and terminate forward of the gusset region on a frontal side of the garment. The first portion may be formed of a plurality of adjoining panels. A seam may extend along one or more edges of the first portion, attaching the first portion to the second portion, wherein the seam is arranged to pass from the vicinity of the waistband, over a wearers buttocks, towards the gusset.

According to a second aspect of the invention there is provided an underwear insert adapted to mould, in use, to the form of the users gluteal cleft or groin region and comprising an activated carbon filter material wherein, in use, any odours emitted from the anus or genital region are forced to pass through the carbon filter material.

In one arrangement the insert is substantially banana shaped and fits in the gluteal cleft such that any gasses emitting from the anus are forced to pass through the insert whereby the odours are filtered by the activated carbon. Preferably the insert forms a seal with the buttocks and the perineum.

In an alternative arrangement the insert is in the shape of a rectangle having rounded ends and a domed upper surface and, in use, is inserted into the gusset region of an undergarment.

The inserts are preferably resilient or malleable so as to easily conform to the shape of the user's body. In one preferred embodiment the inserts are made of flexible polyurethane foam which is covered in an activated carbon material. Preferably the insert is further covered in a nylon hosiery outer covering. In an alternative embodiment the insert comprises a shaped fabric bag containing activated carbon granules.

In a preferred embodiment the two inserts, one of each of the above described shapes, are removably attached to one another to form an insert that extends substantially from the coccyx past the anus and to the genitalia of the user. Preferably the two inserts are attachable by means of hook and loop type fasteners in a manner such that they are pivotal to one another. Preferably the two inserts partially overlap one another.

According to a third aspect of the invention there is provided an underwear garment in combination with at least one insert according to the second aspect on the invention.

In one arrangement the insert may be attached to the underwear garment, either permanently or by removably by such means as hook and eye type fasteners. Alternatively the insert may be located in a pouch created between two overlying panels of the underwear garment. The pouch may be open ended such that the insert can be removed from the pouch. In yet another arrangement the insert may be attached to an elasticized cord that extends substantially from the centre of the rear waistband of the garment to a seam in the central crotch region of the garment.

The underwear garment may have two inserts combined therewith, one associated with the gluteal cleft and one associated with the gusset area of the garment.

Preferably the underwear garment is an underwear garment comprising a first portion shaped to cover at least part of a wearer's groin or buttock region during use and extending into a gusset region of the article, and a second portion shaped to extend around a wearer's body so as to hold the article against the wearer during use, wherein the first portion comprises a filter layer and a backing layer, and second portion comprises one or more textile panels adjacent said first portion and having elasticity greater than the elasticity of the first portion such that the second portion conforms to the shape of the wearer's body. The underwear garment may further comprise any of the additional features of the first aspect of the invention.

An underwear garment having inserts will enable the user to be able to move freely without the fear that odours emitting from the anus or genital region may escape unfiltered.

According to a forth aspect of the present invention there is provided an article of clothing comprising a band of material arranged to pass around a wearer's torso, a first portion depending from said band and arranged to cover at least a part of a wearer's groin region during use, and a sling portion connected to the band at a pair of spaced locations and shaped to pass beneath a wearer's scrotum during use, wherein the sling portion partially surrounds said first portion and the stretch and elongation characteristics of the sling portion differ from that of the first portion such that the sling portion applies a supportive force to the wearer's scrotum during use.

The present invention is advantageous in that the sling portion can lift the scrotum upwardly from an at rest condition such it is supported in a raised condition during use.

This may have the benefit that the wearer feels supported in the groin area during movement and can reduce the likelihood of contact between the testes and the wearer's thighs.

In one embodiment, the resilience of the sling portion may be greater than that of the first portion. The tension of the sling portion may be greater than that of the first portion. The stiffness of the sling portion may be greater than that of the first portion. The elasticity of the sling portion may be greater than that of the first portion.

The sling portion may be connected or connectable to the band at an oblique angle. The sling portion may take the form of a generally U-shaped or V-shaped piece of material. The thickness of the sling may increase towards a central region adjacent the scrotum and decrease towards the band. The elasticity of the sling portion may increase towards the band. This type of sling can advantageously apply lift over a generally larger central area in contact with the scrotum. The elasticity in the upper portion of the sling, close to the waist band avoids the scrotum being pressed into a wearer's body and instead cups the scrotum such that it is held generally forward of its at rest condition.

The article of clothing may comprise a second or further portion depending from the band. The sling portion may be interposed between the first portion and second portions. The sling portion may be attached to the first and second portions along its edges in such a way that a central area of the sling portion protrudes forwardly of the adjacent first or second portion. The sling portion may be shaped to have a support area which protrudes obliquely from the adjacent material portion so as to form a cradle-like support.

The sling portion may be adjustable. In one embodiment the sling portion is adjustably connected to the band by one or more adjustable fastener formations. Suitable formations may comprise a buckle, poppers, buttons, Velcro (RTM) or the like. The sling portion may comprise a plurality of fastener formations extending along a portion of the sling for selective attachment to a corresponding fastener formation associated with the band. The fastener formations may be arranged in a substantially linear arrangement. The user can select which fastener formation is attached to the band to adjust the tension in the sling.

According to one embodiment, the sling fastener formations may comprise one or more apertures, slits or eyes shaped to receive a button.

The band may comprise a plurality of fastener formations arranged about the band. Thus the user can adjust the angle at which the sling attaches to the band. This can be used to adjust the fit and support provided by the undergarment for a particular wearer. The sling portion may comprise a central support region and elastic arms extending outwardly therefrom for connection to the band.

According to a fifth aspect of the present invention, there is provided an article of clothing according to both the first and forth aspects. The combined effect of the first and forth aspects can lead to functional benefits.

According to a further aspect of the present invention, there is provided a method of manufacture of an article of clothing according to the first aspect.

According to a further aspect there is provided a method of manufacture of an article of clothing according to either of the forth or fifth aspects.

Specific embodiments of the present invention are described below by way of example only with reference to the accompanying drawings, of which:

Figure 17A:
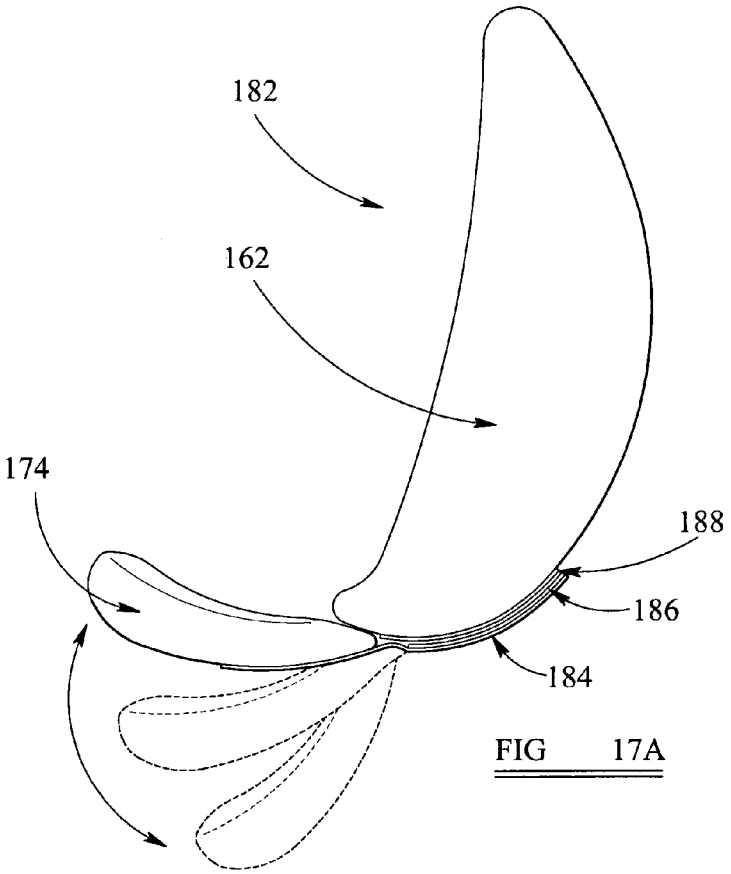
Figure 17B:
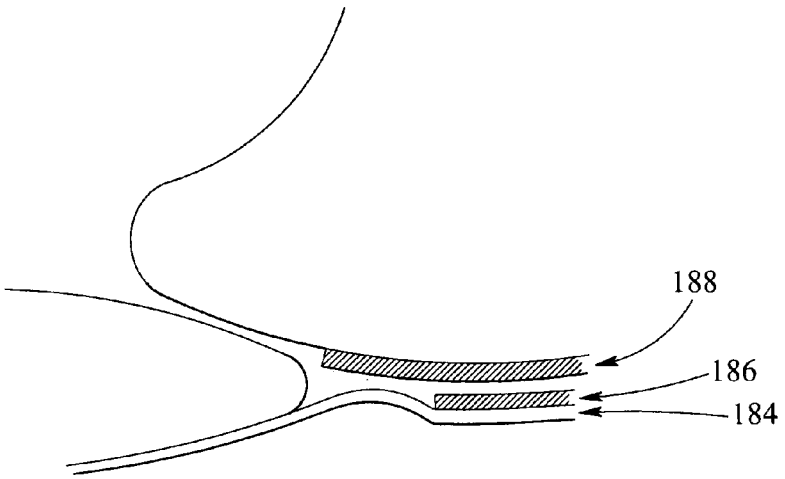

FIGS. 15*a* to 15*e* show various elevations of an insert according to the second aspect of the invention;

FIGS. 16*a* to 16*e* show various elevations of an alternative insert according to the second aspect of the invention;

FIG. 17*a* shows a combination insert according to the second aspect of the invention;

FIG. 17*b* shows a close up view of part of FIG. 17*a;*

Figure 1:
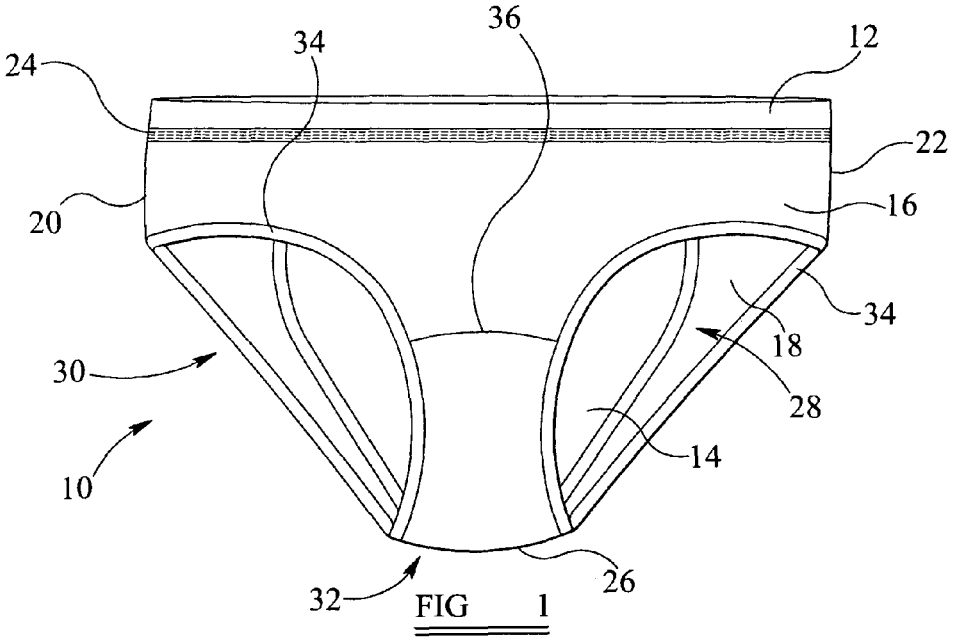
FIG. 1 is a front view of an article of clothing according to one embodiment of the present invention.
Figure 2:
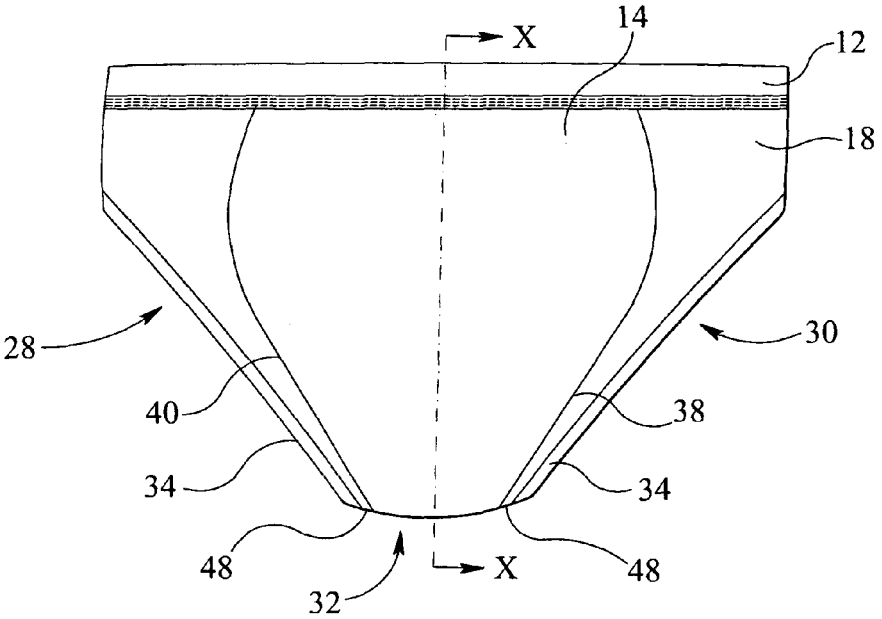
FIG. 2 is a rear view of the article of clothing of FIG. 1.
Figure 18A:
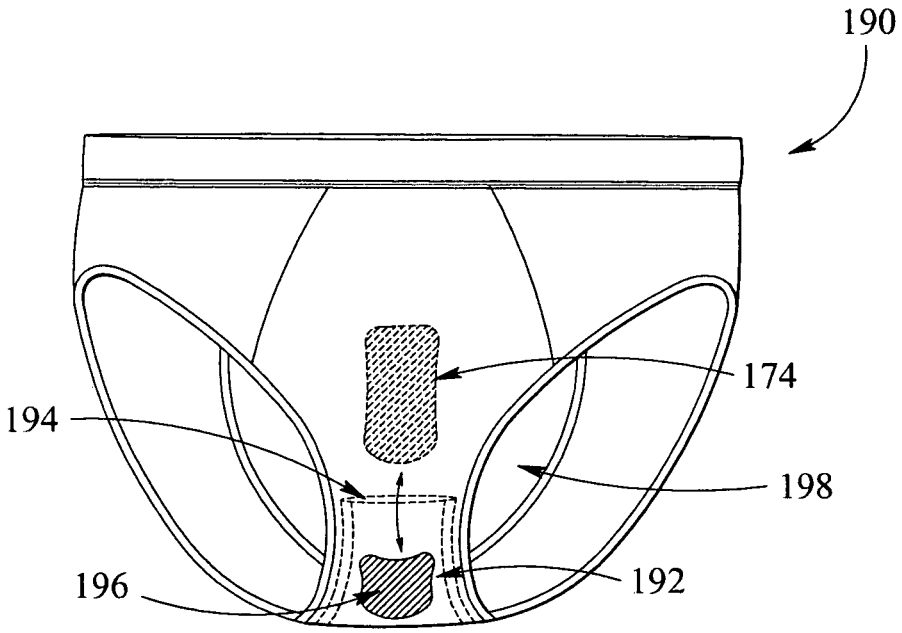
Figure 18B:
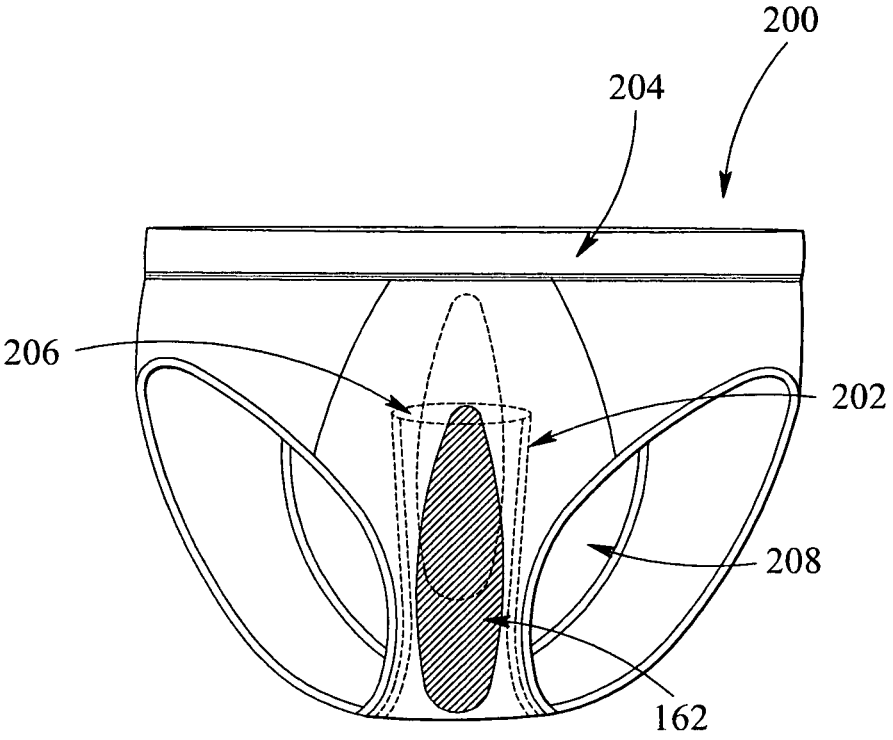
Figure 19A:
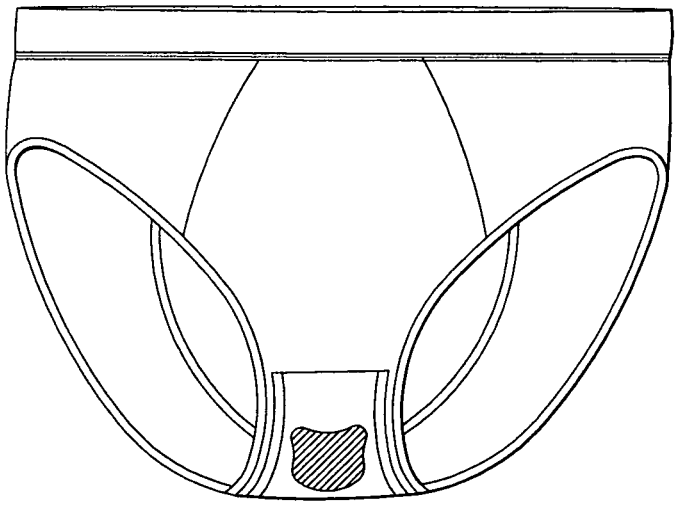
Figure 19B:
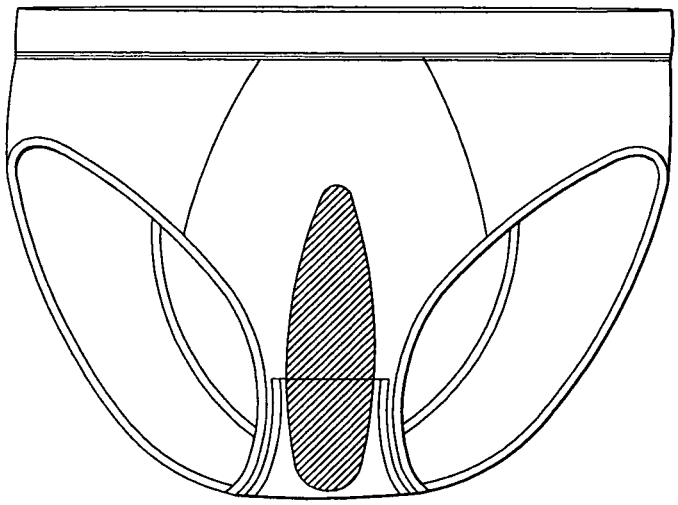
Figure 20A:
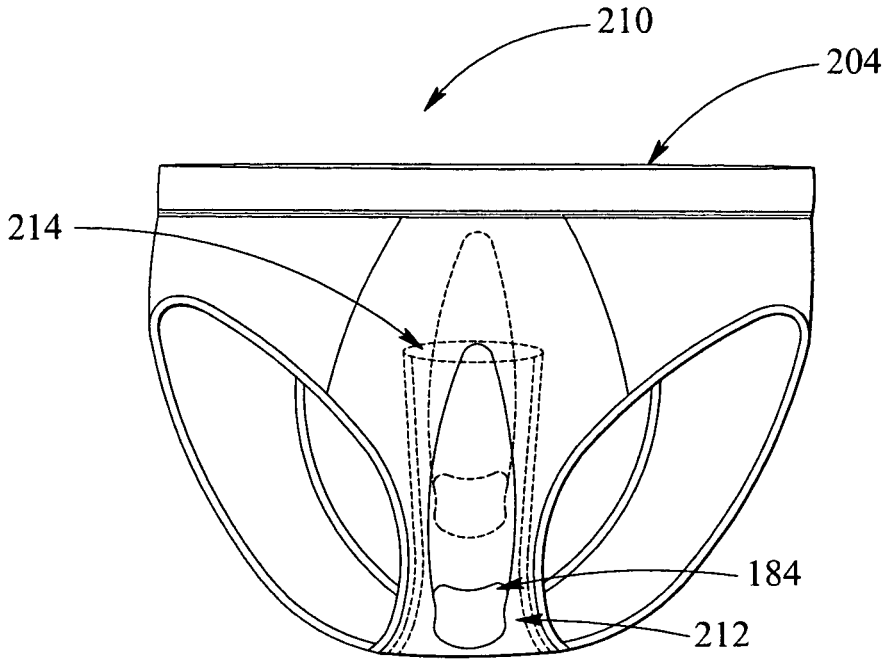
Figure 20B:
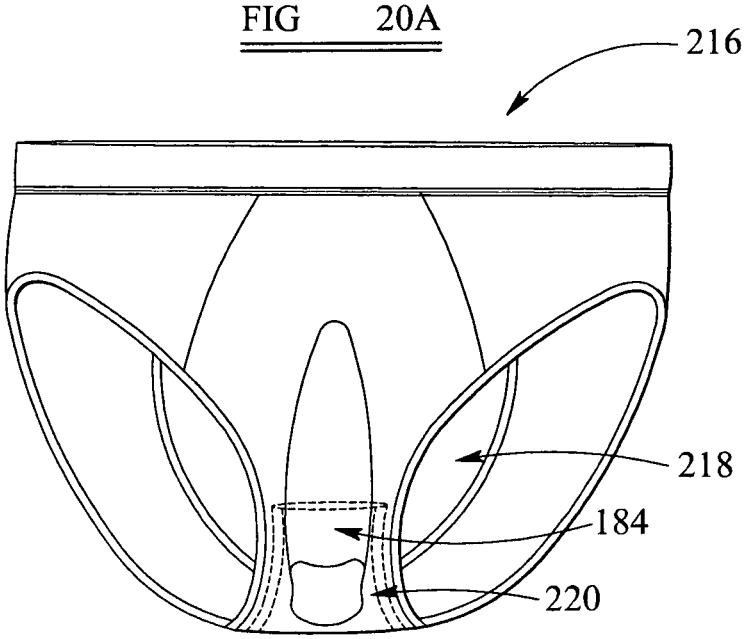
Figure 21:
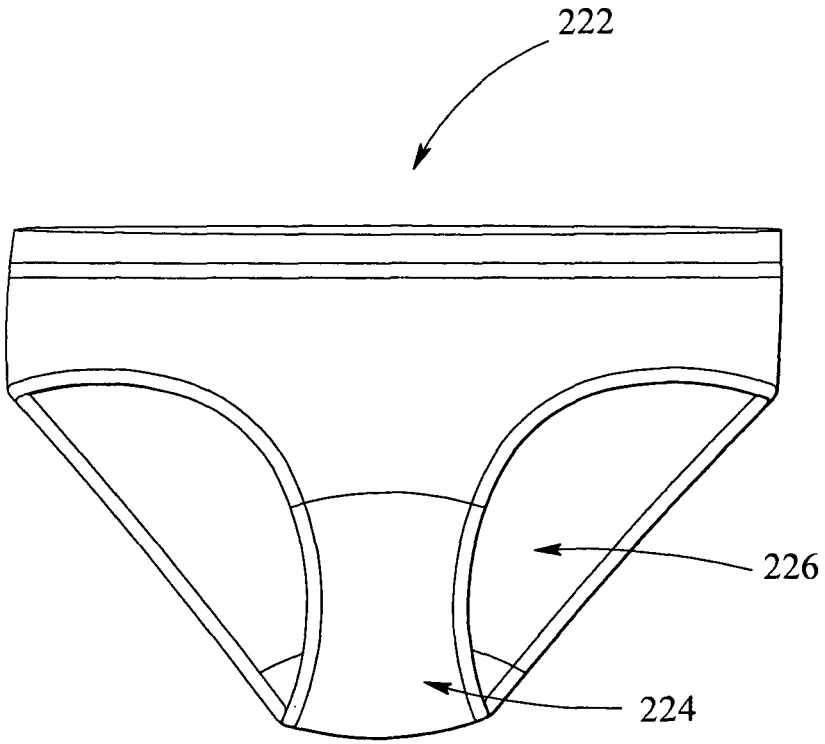

FIGS. 18*a* and 18*b* show underwear garments according to the third aspect of the invention having removable inserts;

FIGS. 19*a* and 19*b* show underwear garments according to the third aspect of the invention having fixed inserts;

FIGS. 20*a* and 20*b* show underwear garments according to the third aspect of the invention having combined inserts of FIGS. 19*a* and 19*b*; and FIG. 21 shows an undergarment for enhanced feminine hygiene. Turning firstly to FIGS. 1 and 2, there is shown an article of clothing 10 formed of a plurality of panels or sections of material. These sections are marked as 12, 14, 16 and 18 where 12 represents an elasticated waist band, 14 represents a gas filter section, 16 represents a front panel of material and 18 represents a rear material panel.

The front 16 and rear panels may be stitched together along lines 20 and 22 adjacent the waistband 12 on opposing sides of the garment so as to form seams. The waist band 12 is stitched along the upper edge of the garment 10 so as to form seam 24. The seam 24 may be a multiple seam and may be stitched a plurality of times to ensure the strength of the join and/or for aesthetic appeal. In this example the seam 24 is triple stitched.

The front 16 and rear 18 panels are also joined to a gusset region 32 which is attached between the front and rear panels. The gusset panel 32 is stitched to the lowermost edge of each of the front and rear panels. However it will be appreciated by those skilled in the art that the front and rear panels may be formed of a single piece of material which would not require a separate gusset panel. Alternatively, the front and rear panels may be shaped such that they are sewn directly together in the vicinity of the lowermost edge 26 or else edge 36 of the gusset region without the need for an additional gusset panel.

The front and rear panels are shaped so as to provide leg openings 28 and 30, spaced by the gusset region 32. The leg openings are fitted in that they are designed to closely adhere about the upper region of a wearer's leg. The periphery of each opening 28, 30 is provided with a resilient or elastic edging 34.

The edging is provided by way of an additional elastic material strip sewn about the entire periphery of each leg opening. The diameter or circumference of the opening at rest is typically slightly smaller than the corresponding dimension of a wearer's upper leg. Thus the edging strip and the leg opening is stretched or tensioned when the garment is worn. This ensures that the leg opening maintains continual contact around the wearer's upper leg or thigh region.

In this embodiment, the front and rear panels are formed of cotton and Lycra fibres. The composition may be 92% cotton and 8% Lycra although it may also be possible to use a combination of other fibres including elastanes, such as a modal and elastane mix. The waistband may comprise an elastomer or elastomeric yarns such as elastane or spandex, which typically comprises polyurethane. The edging material comprises a strip of folded leg elastic having 1 cm width. However it will be appreciated that a variety of suitable materials are available and may be substituted for the materials listed above.

The elasticity of the waistband and the edging material is greater than that of the front and rear panels.

The gas filter section 14 shown in FIGS. 1 and 2 extends from the waist band on the rear side of the garment as shown in FIG. 2, down to the gusset region and through the gusset such that the section 14 terminates at seam 36 on the front panel 16 as shown in FIG. 1. The edge 36 of the filter section is located close to, and typically above, the narrowest portion of the gusset region 32 between leg openings 28 and 30.

The filter section terminates between 2 and 14 cm above the lowermost edge of the gusset 32 when the article is laid flat as shown in FIGS. 1 and 2. In this embodiment the filter section 14 terminates approximately 10 to 14 cm above the lowermost edge.

As shown in FIG. 2, there are a pair of opposing seams 38 and 40 at opposing edges of the filter section 14 where the filter section is connected to the rear panel 18. These seams 38 and 40 extend downwardly from the waistband, over the rear panel and through the gusset. The seams and the corresponding edges of the filter section 14 are shaped such that the filter section broadens to a widest portion in a mid section between the gusset and the waistband. The filter section narrows to a narrowest section in the vicinity of the gusset.

The seams are typically curved in shape defining respective curved edges of the filter section. The curve of the seams is such that the seams conform to the shape of a wearer's buttocks such that the seams are widest apart in the mid height region of a wearer's buttocks. This shape has been found to promote close contact between the seam and the buttocks such that the seam acts as a seal, which inhibits escape of gas from between the buttocks.

Figure 3:
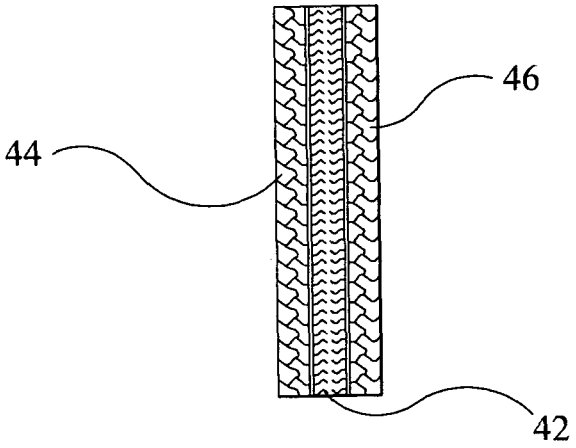
FIG. 3 is a sectional view of the first portion of the garment taken through the plane X-X in FIG. 2.

The material layers forming the filter section 14 are shown in FIG. 3 and comprise a filter material 42 trapped between opposing layers of material 44 and 46. The filter material comprises or consists of an activated carbon textile. A suitable carbon textile is typically produced by heating fibres such that they attain a relatively porous carbon composition. Typically, the carbon textile is produced by heating viscose woven fibres in order such that they attain a relatively porous carbon composition due to the action of the heat carbonising the surface of the individual fibres. Such fibres have conventionally been typically brittle, relatively inelastic and difficult to manipulate as a result of heat treatment, negating their use in complex garments, such as underwear, which are subject to a high degree of movement and mechanical forces.

However, it is of significant benefit of the present invention that the filter media is comprised principally of a knitted material that has been the subject of a novel heat treatment process which enables the material to retain its flexibility and mechanical strength; making it suitable for use in accordance with the present invention. Aside form the material properties of the fibres, the knitting of such fibres further allows a freedom of movement which is not catered for in conventional woven fabrics.

The filter material 42 shown in FIG. 3 represents a simplified embodiment and the filter portion may in fact comprise or consist of an activated carbon textile layer having one or more adhesively bonded backing layers. Such bonded backing layers may be in addition to layers 44 and 46 and may be used to improve mechanical performance. Thus the filter 42 itself may take the form of a layered material such that the stretch, elongation and strength of the filter are suitable for use in a garment according to the present invention.

The processing of the knitted carbon textile provides it with sufficient give that the cloth can expand to take account of movement of the wearer's body. In addition, the relatively brittle nature of carbon fibres can be further overcome by providing the one or more backing materials 44 and 46.

The activated carbon textile in the rear panel and also in the gusset panel absorbs and filtrates out flatulence odours. In testing it has been found that odorous gasses present on one side of such a filter membrane are almost entirely absent on the opposing side after significant periods of exposure. Similarly constructed filters have been statically exposed to a range of odorous gases and have been found, over periods of observed testing, to provide highly effective odour removal.

The layers 44 and 46 may be the same as the material of the front and rear panels. In one embodiment, the rear panel forms the outer material layer 46 of the filter section 14. Thus the filter section comprises the layers 42 and 44 applied to the rear panel material 46. The composition of FIG. 3 is also applicable to the gusset region 32 such that the multiple layer filter section extends from the rear panel through the gusset.

However, as shown in FIG. 2, the filter section 14 is narrower in the region of the gusset than the gusset itself. Thus the filter section is spaced from the edge of the garment by a portion of non filter-material. In the vicinity of the gusset, the filter section 14 is bounded by a portion 48 of the rear panel 18 and also the edging 34. The fact that the filter panel does not run to the edge of the garment is important in ensuring the adherence of the garment to the body of a wearer so as to ensure gas cannot escape around the filter section 14.

Due to the makeup of the filter section 14, the filter area is generally less compliant than a remainder of the garment, such as the front or rear panels. Thus the mismatch between material properties is used to good effect in the present invention by ensuring that the filter section substantially maintains its positioning and shape over the buttocks and gusset region to cover the anus area, whilst the remainder of the garment is more compliant and can stretch or otherwise move to take account for movement of the wearer, without dislodging the filter section.

However the provision of the filter section in a layered cloth format substantially avoids the discomfort or irritation associated with prior art gas filters.

The properties and construction of the embodiments of FIGS. 4 to 7 are substantially as described above except for the differences highlighted below. The description of like features in those embodiments is omitted for conciseness.

However it will be appreciated that the dimensions of the styles of garment shown in FIGS. 4 to 7 may differ from those of FIGS. 1 and 2.

Figure 4:
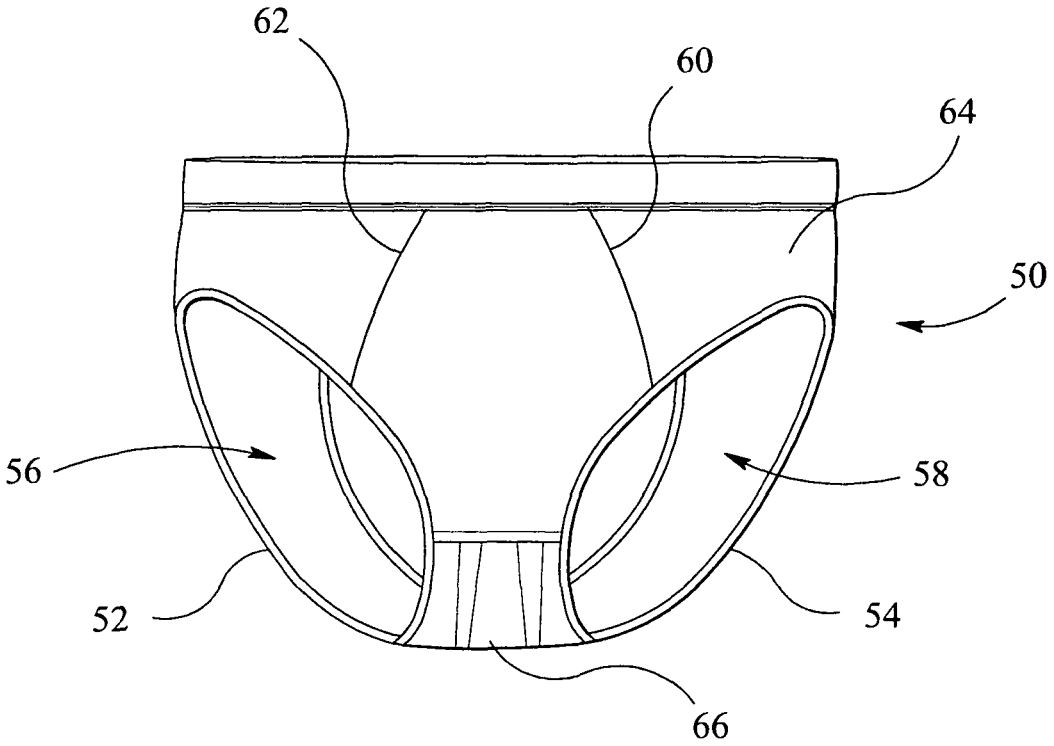
FIG. 4 is a front view of an article of clothing according to a second embodiment of the present invention.
Figure 5:
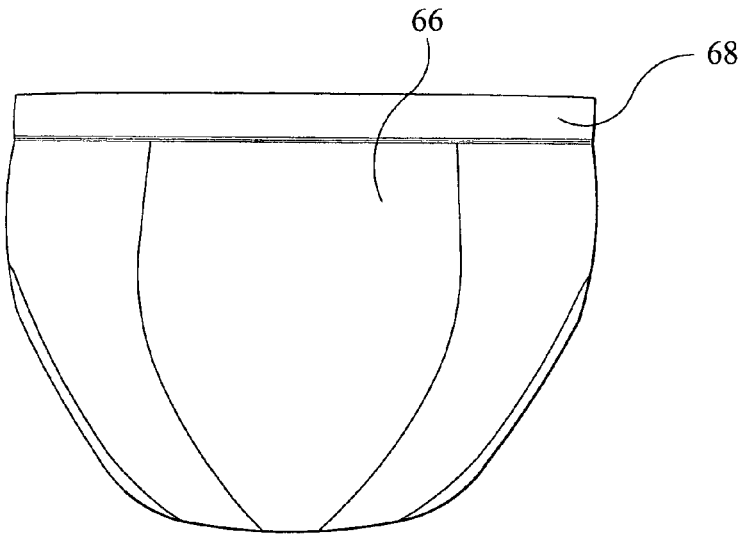
FIG. 5 is a rear view of the embodiment of FIG. 4.

Turning now to FIGS. 4 and 5, there is shown a respective front and rear view of an undergarment for use by a man. This style of undergarment is commonly referred to as men's briefs. In this embodiment, the rear panel is more rounded and fuller than the tapered rear panel of FIG. 2 and is intended to cover the majority of the wearer's buttocks. In this regard, the rearward edges 52 and 54 of openings 56 and 58 are shaped to pass substantially around the perimeter of the buttocks. Thus the edges 52 and 54 are arranged to pass along the crease between a wearer's buttocks and upper thigh when standing.

Additional seams 60 and 62 are provided in the front panel 64. The front panel 64 may be formed of a plurality of panel sections and may comprise overlapping panels so as to allow for an opening when a wearer wishes to urinate.

In FIG. 5, it can be seen that the shape of the filter section 66 is different to that of FIG. 1 in order to account for the general shape of the male buttocks and groin region. In particular an upper portion of the filter section adjacent the waistband 68 has relatively straight edges such that the width of the filter section is relatively constant in that region.

The filter section then tapers to a narrower shape than that of the previous embodiment as it passes through the gusset region. This allows for a greater width of non-filter material on either side of the filter section as it passes through the gusset. This allows for greater flexibility such that the garment can better adapt to the male groin area.

The filter section extends through the gusset region and terminates immediately adjacent or behind the wearer's scrotum during use.

Figure 6:
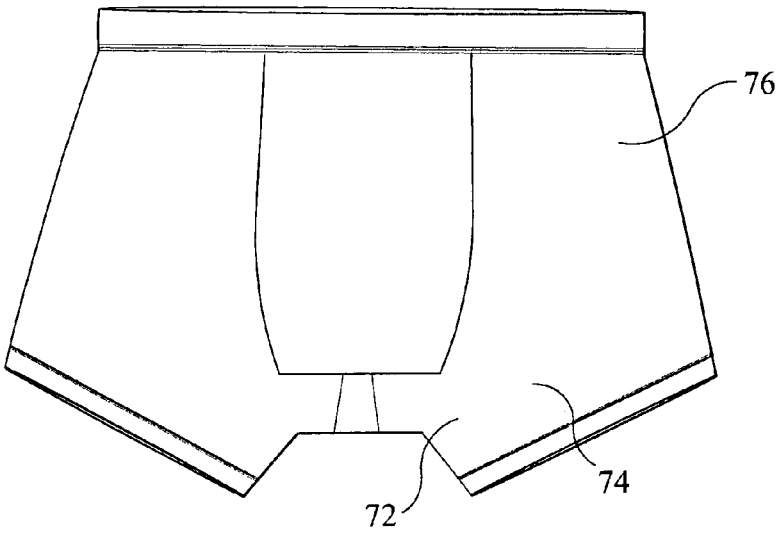
FIG. 6 is a front view of an article of clothing according to a third embodiment of the present invention.
Figure 7:
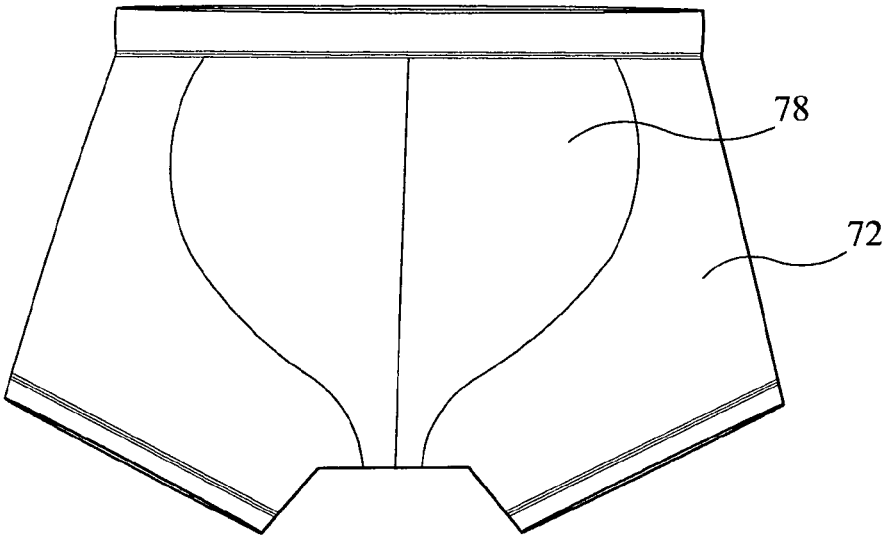
FIG. 7 is a rear view of the embodiment of FIG. 6.

FIGS. 6 and 7 show another embodiment in which the garment 70 takes the form of a pair of shorts or boxer shorts, of design commonly referred to as men's Hipsters. In this embodiment the shape of the front and rear panels has been modified such that they extend about the upper portion of a wearer's thighs. Thus the shape of the leg openings have been modified to conform to the upper thigh rather than the buttocks and groin area.

In addition, the rear panel 72 is shaped to extend completely around the gusset and terminates at seam 74 where the rear 72 and front 76 panels meet on the front side of the garment. Thus the rear panel is of greater dimensions than the front panel.

In this embodiment, the filter section 78 is wider over the buttock region and may be up to 20 cm in width. The curvature of the filter section 78 displays a greater curvature and covers a greater area of the buttocks than the earlier embodiments. In a similar manner to the embodiment of FIGS. 4 and 5, the filter section narrows to a relatively small width in the groin or gusset region. The edge of the garment is much further spaced from the filter section in the gusset region by virtue of the modified shape of the front and rear panels to cover the upper thigh region of the wearer.

In the embodiment of FIGS. 6 and 7, the front and rear panels may be made of a knitted jersey cloth and may comprise a combination of Modal and elastane. The cloth will typically comprise 90% or more Modal and 10% or less elastane. However other combinations of fibres are possible such that the cloth comprises a relatively supple component and a smaller amount of a relatively elastic component.

Turning now to FIGS. 8 to 12, there are shown a number of embodiments of garments according to the second aspect of the invention. In the embodiments shown it will be appreciated that those embodiments also conform to the requirements of the first aspect of the invention. However the provision of a filter section is not essential for the second aspect of the invention and may be removed.

Figure 8:
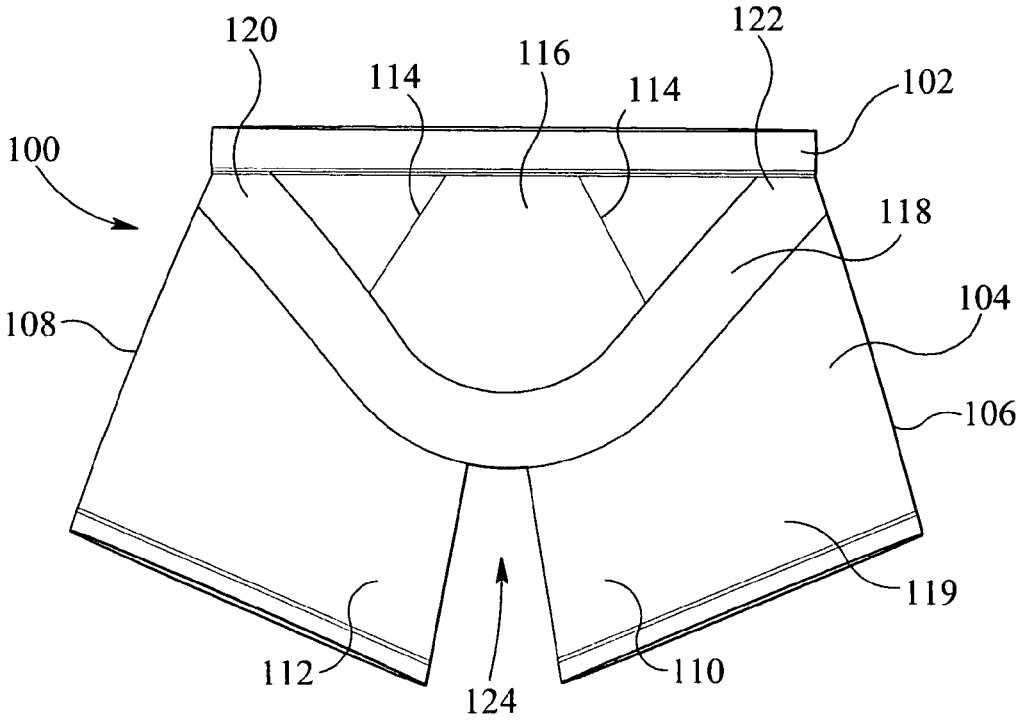
FIG. 8 is a front view of one embodiment of an article of clothing according to the second aspect of the present invention.

In FIG. 8, there is shown an article of clothing in the form of an undergarment 100 having a waistband 102 which may be substantially the same as the waistband described in relation to FIGS. 1 and 2. The garment 100 has front 104 and rear 106 panels arranged and comprising materials substantially as described in relation to the front and rear panels of FIGS. 6 and 7. Typically the garment 100 will have seams on opposing sides 106 and 108 of the garment as well as seams 110 and 112 running down the inner leg.

The garment may also have oblique seams 114 and/or an opening in the front panel as described above.

The embodiment of FIG. 8 differs from those described above in that the front panel has a first section 116 depending form the waistband 102 and bounded by a further material section in the form of sling section 118. The sling 118 is a rounded V-shape strip of material of one or more layers having opposing ends 120 and 122 which are attached by stitching to waistband 102 or else to the front panel in the vicinity of the waistband. The ends of the sling are attached to the waist band 102 towards the opposing sides 106 and 108 of the garment. Thus the ends 120 and 122 are spaced apart in such a manner that the first section 116 is substantially triangular or semi-elliptical in shape and is enclosed by the waistband 102 and the sling 118.

A further portion 119 of the front panel is attached to the opposing side of the sling 118 from the first portion 116. As with the first portion, the further portion 119 is typically stitched along the edge of the sling. The further portion is typically formed of the same material; as the first portion and may have an elastic trim in the vicinity of the leg openings.

The sling 118 passes from the waistband down towards the gusset region 124 between the first and further 119 portions. The sling section is formed of a material having different characteristics to that of the first section 116. In this embodiment, the sling is formed of a double layer of textile or cloth such that it has increased resilience to elongation or stretch. Each of the two or more layers of the sling section may comprise a cotton and Lycra mix of fibres which may comprise roughly 95% cotton and 5% Lycra.

In an alternative embodiment, the sling may comprise an increased composition of elastic material and may comprise one or more layers of material.

During use the sling passes from the waistband to under the wearer's genitals, thus providing additional support to the wearer during use. The sling may display a tension greater than that of the first portion 116.

The sling is sewn to either or both of the first 116 and further 119 portions of the front panel at an angle such that there is an excess of material on the front side of the garment. Thus the sling material is gathered such that if the garment is laid flat on the rear panel, the material in the vicinity of the apex of the sling would bunch or protrude upwardly out of the plane of the garment. This arrangement of material defines a pouch or recess in the vicinity of the sling within which the wearer's genitals can be located.

The angled nature of the sling section also serves to lift and support the genitals such that they protrude forwardly of the wearer's groin and prevents the genitals being overly pressed against the wearer's body.

Figure 9:
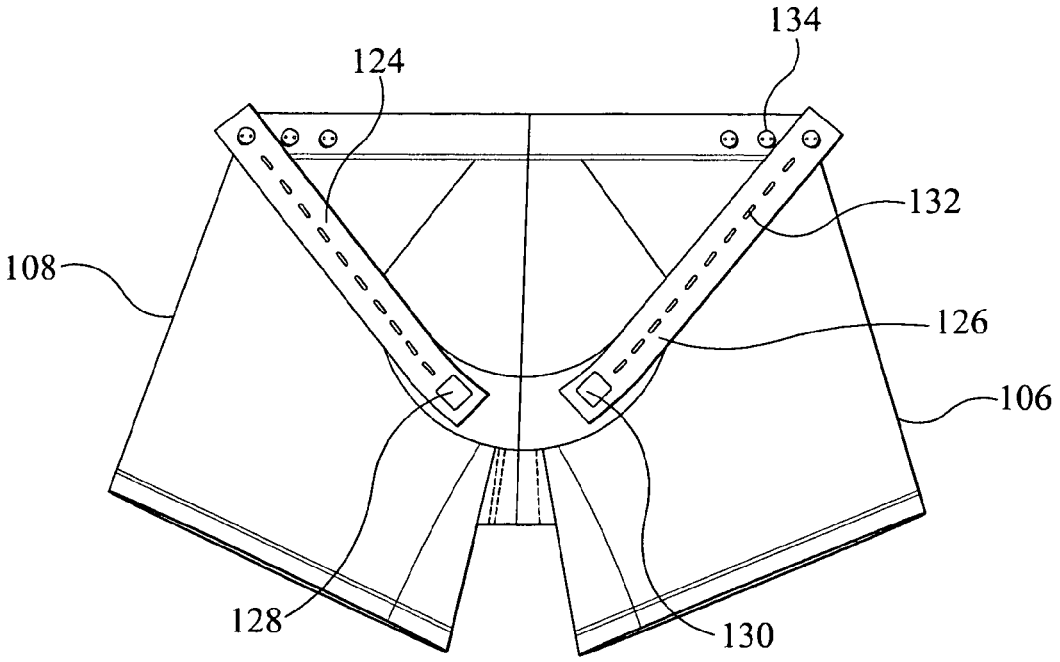
FIG. 9 is a front view of a second embodiment of the second aspect of the present invention.

Turning now to FIG. 9, an alternative embodiment is shown which is substantially as described in relation to FIG. 8, except that the sling section is provided with one or more adjustable straps. In this embodiment, a pair of straps 124 and 126 are shown and extend obliquely from spaced locations on the waistband towards the gusset region. The straps 124 and 126 substantially follow the path of the sling section and are attached to the waistband towards the opposing sides 106, 108 of the garment. This connection point in the vicinity of a wearer's hips advantageously prevents the band being pulled down during use.

The opposing straps are attached to the sling 118 part way between the edge and the centre of the garment, on either side of a centre of the garment. The straps are stitched to the sling portion at 128 and 130 respectively.

The straps 124 and 126 have a plurality of fastening formations in the form of button holes 140 along their length. The waist band 102 has one or more corresponding fastening means in the form of buttons 134 thereon. Thus the strap can be attached to the waistband by insertion of a button in the desired button hole 132. The strap can be adjusted by selecting a higher or lower button hole for attachment to the waistband in order to vary the amount of lift and/or support required by the wearer.

Figure 10:
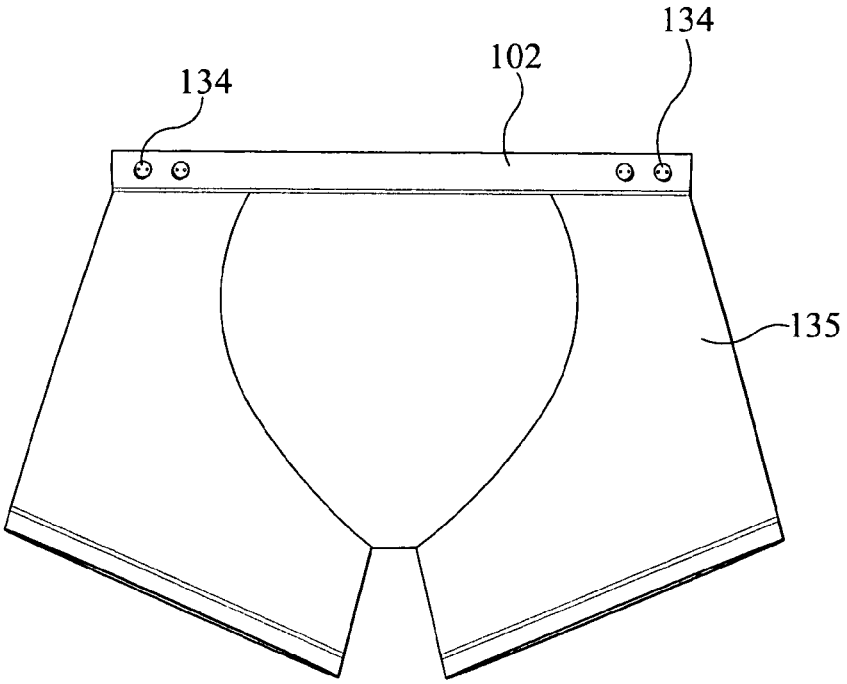
FIG. 10 is a rear view of FIG. 9.

In this embodiment the waistband comprises a plurality of buttons at spaced location thereon. The buttons 134 are provided typically at least towards the opposing sides of the garment. As can be seen in FIG. 10, the buttons extend from the front around to the rear of the garment. Thus an appropriate button can be selected for attachment of the strap in order to vary the lift and/or angle of applied support to the genitals. Either of the combination of multiple buttons or multiple button holes may be used independently in one garment.

The straps may be formed of a substantially inelastic material such as a woven web or the like or else may be formed of an elastic material dependent on the required level of comfort and/or lift to be provided.

The rear material panel 135 shown in FIG. 10 may be applicable to any of the embodiments of FIGS. 8 to 12 and may be formed of any material described above.

Figure 11:
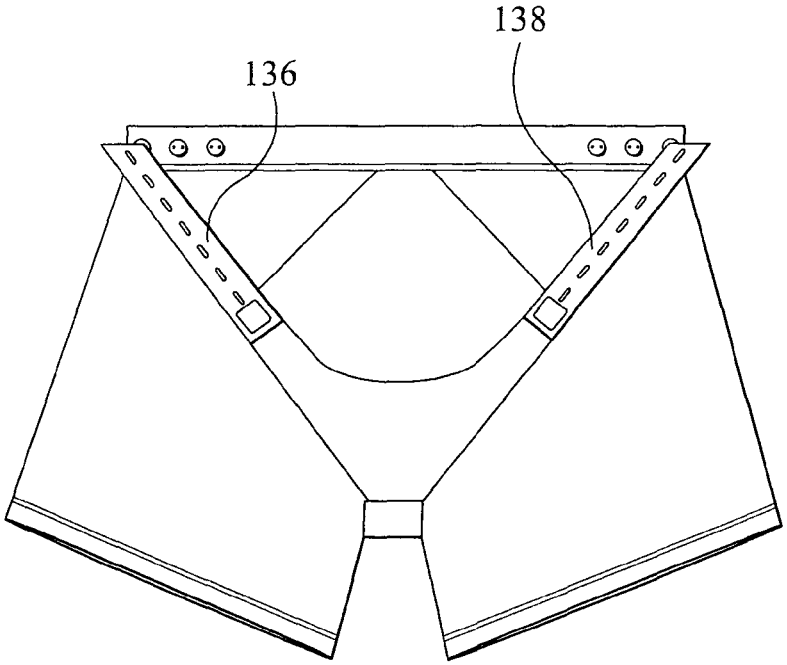
FIG. 11 is a front view of a third embodiment of an article of clothing according to the second aspect of the present invention.

An alternative embodiment is shown in FIG. 11, in which the adjustable straps 136 and 138 are shorter in length to those of FIG. 9. Thus the straps apply tension to the sling portion further from the central region of the garment and may be connected to the sling approximately half way between the centre and the outer edge of the garment. This is in contrast to the embodiment of FIG. 9 in which the straps contact the sling between ⅔ and ¾ of the distance from the outer edge of the garment to its centre.

The shape of the sling in this embodiment is also different to that of FIG. 9 and shows a greater angle between the sling and the waistband. Thus the sling is shaped to provide a deeper V shape.

Figure 12:
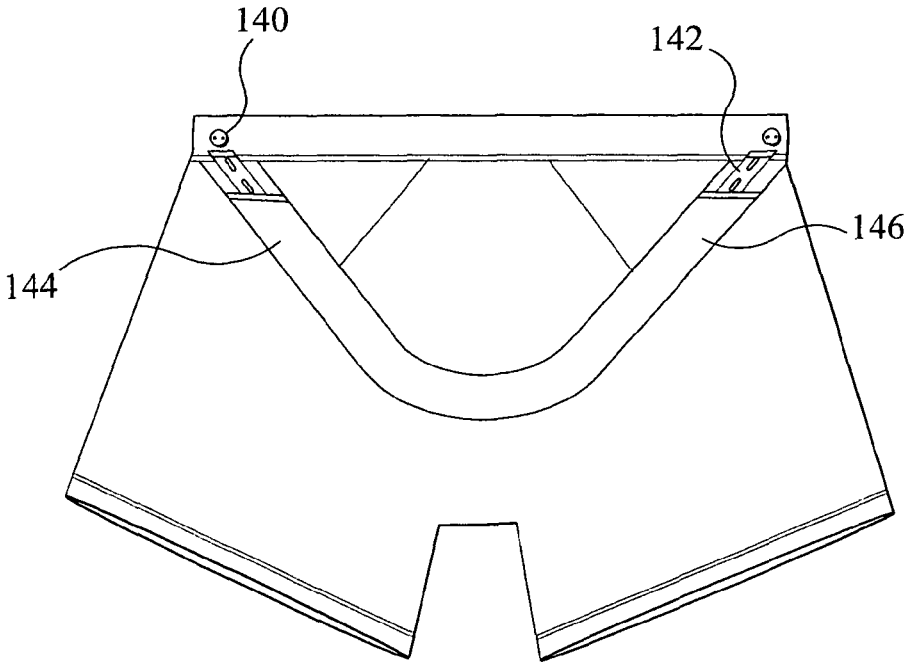
FIG. 12 is a front view of a fourth embodiment of an article of clothing according to the second aspect of the present invention.

In FIG. 12, there is shown an embodiment similar to that of FIGS. 9 to 11, save that the straps 140 and 142 are covered. This is achieved by attachment of a cover material over the sling section 118 and stitching the cover along the sling section edges so as to form one or more sleeves 144 and 146 for reception of the straps. The cover material stops short of the waistband 102 such that the ends of the straps protrude beyond the sleeves 144, 146 for attachment to the waistband. In this embodiment the cover material may be a single or double layer material similar to either the first portion or else the sling material.

Figure 13:
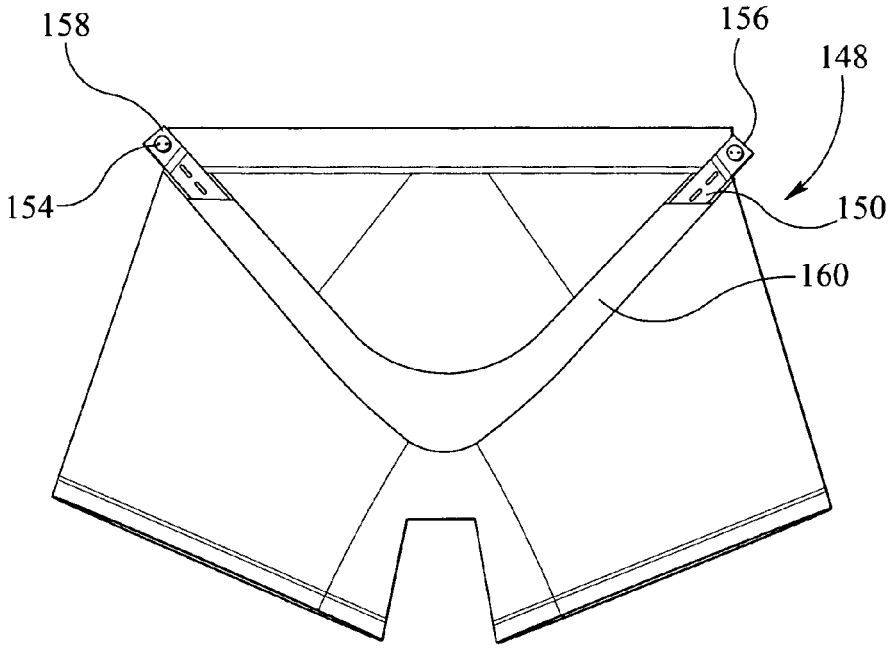
FIG. 13 is a front view of a fifth embodiment of an article of clothing according to the second aspect of the present invention.
Figure 14:
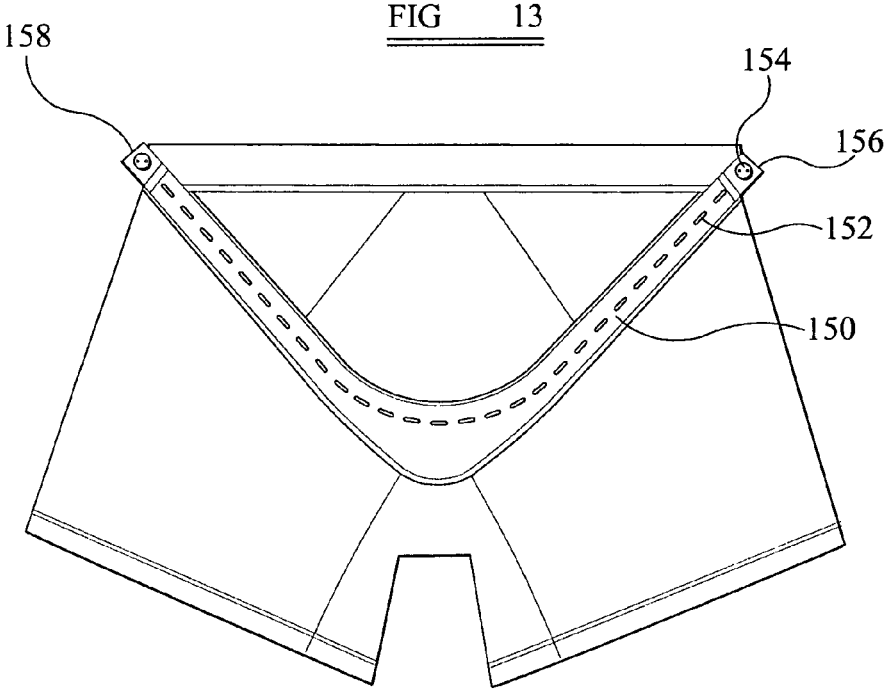
FIG. 14 is a front view of the embodiment of FIG. 14 with the sling strap exposed.
Figure 15A:
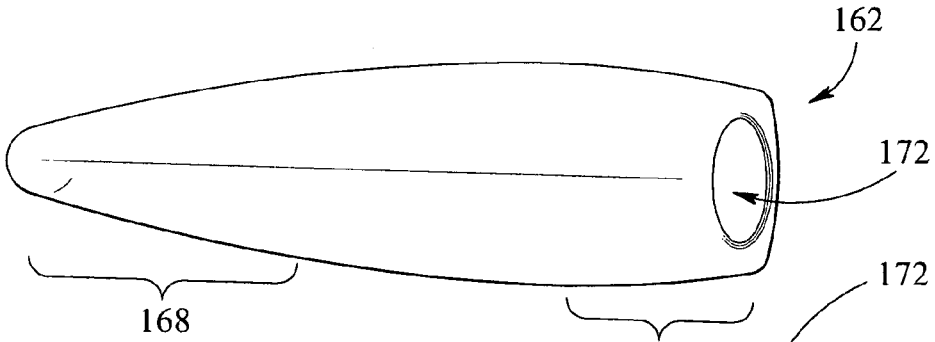
Figure 15B:
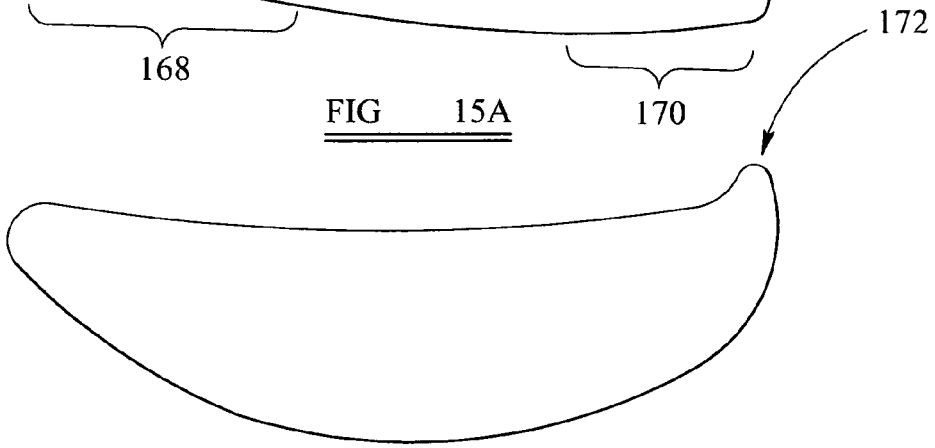
Figure 15C:
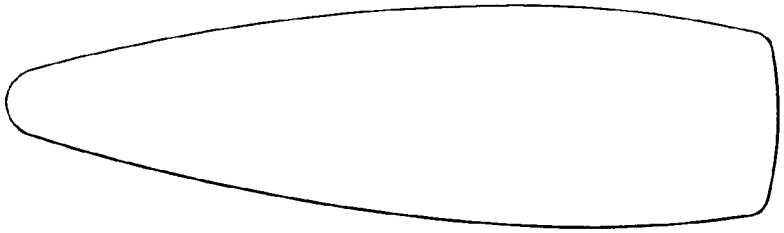
Figure 15D:
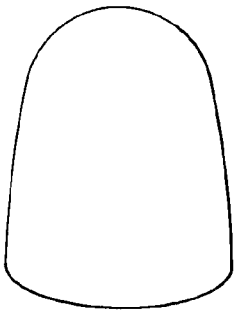
Figure 15E:
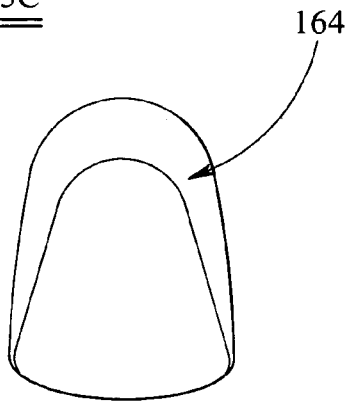
Figure 16A:
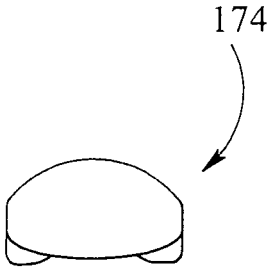
Figure 16B:
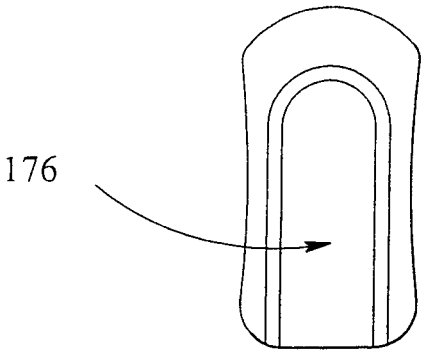
Figure 16C:
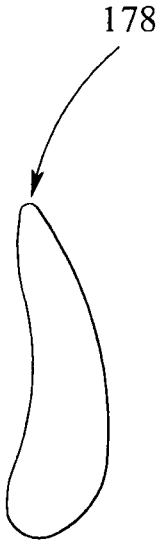
Figure 16D:
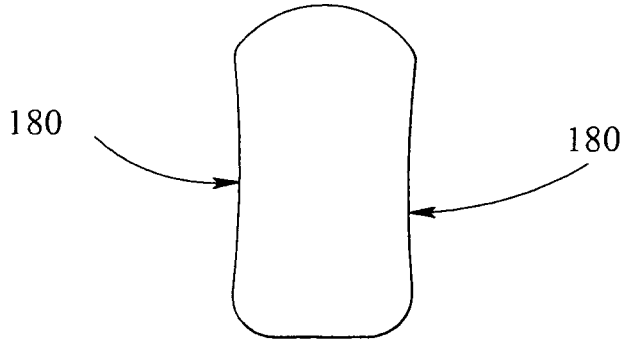
Figure 16E:
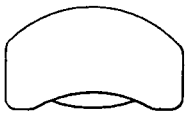

Turning now to FIGS. 13 and 14, there is shown a further embodiment of an undergarment 148 according to the present invention. The garment 148 is substantially as described above in relation to FIGS. 9 to 12, except that the pair of straps 124 and 126 have been replaced with a single strap 150.

The strap 150 has attachment formations in the form of button holes 152 along its length and is attachable to corresponding attachment formations in the form of buttons 154 on the waistband 156 of the garment 148. Opposing ends 156 and 158 of the strap 150 can thus be fastened to opposing sides of the garment in the vicinity of a wearers hips such that the strap passes from the waistband on one side of the garment, down towards the gusset region, beneath the wearer's scrotum and penis, and then back up to the waistband on a second side of the garment.

The strap 150 is generally curved in a substantially U-shaped or V-shaped arrangement for use.

The sling portion of the garment 148 is provided with an additional layer of material 160 which covers the strap 150 along at least a portion of its length. The material 160 typically covers the strap along a majority of its length, allowing only the end portions 156 and 158 of the strap to be exposed. The cover material 160 is stitched to the sling portions along opposing edges thereof so as to form an elongate sleeve for the strap. In this embodiment a single continuous sleeve is formed which is curved or generally V-shaped such that the strap can pass completely therethrough.

The cover material may comprise any of the materials described above. In addition the strap may be elasticated or else may comprise a substantially inelastic length of material, such as for example a woven material.

The strap 150 can be tightened or loosened by adjusting the button hole used to fasten the strap to the buttons on either side of the garment. Multiple buttons may also be used for adjustment of the strap about the waistband in a manner described above and shown in FIGS. 9 to 11.

Whilst the strap 150 is releasably fastenable to the waist band at each end in FIGS. 13 and 14, it will be appreciated that, in an alternative embodiment, the strap may be permanently fixed to the garment at one end 158 by stitching. Thus only one end of the strap is required to be releasably fastened to the garment for adjustment of the strap. The tension applied to the single strap design will tend to be substantially evenly distributed along its length resulting in an even tension in the strap using fastening formations at only one end of the strap. The fixed end of the strap 150 may be sewn to the waistband, typically at its lower edge, or else immediately below the waistband.

The additional support provided by the embodiments of FIGS. 8 to 14 has been found to be of particular benefit to men during long distance driving or else during exercise, although it will be appreciated that the present invention is not limited to such uses and the present invention does not preclude general use or else for use by an individual to emphasize the prominence of their genital region.

In any of FIGS. 9 to 14, the first portion 116 may comprise a double layer of material in order to provide increased resilience and greater support of the genitals. By virtue of the straps, the characteristics of the sling remains different from that of the first portion.

When the fist and second aspects of the invention are combined, as shown for example in FIGS. 8 to 14, the sling further helps to ensure close contact between the garment and the wearer's skin in the groin region by application of an upward tensile force. This force further inhibits passage of any gas emitted from the anus around the filter member and thus furthers the effectiveness of the function of the undergarment.

In all of the above embodiments, the elastane waistband typically shows greater elasticity than that of a conventional undergarment in order to ensure close contact of the garment to the user's body and to reduce unwanted slippage of the garment through use. Thus the waistband has been developed with increased strength specifically for the garment according to the present invention.

Any or any combination of the front, rear and/or sling panels described above may comprise a jersey fabric.

Referring to FIGS. 15*a* to 15*e* an insert 162 for an underwear garment is shown. FIGS. 15*a* to e show top, side, bottom, right end and left end views respectively. The insert 162 is elongate and substantially banana shaped. The insert 162 comprises a flexible polyurethane foam core 164 covered by a knitted material 166 made of activated carbon fibres. The core 164 is shaped to be located, in use, in the gluteal cleft of a user and to substantially contact the user's body from the coccyx to the perineum and along the inner surfaces of the buttocks. In this manner, any gas emitting from the anus of the user is forced to pass through the insert and the activated carbon material acts to filter any odours from the gas. The insert 162 has a tapered end 168 that locates, in use, towards the coccyx end of the gluteal cleft and a wider end 170 that locates, in use, towards the perineum. The insert 162 has a slightly hooked extension 172 that extends from the wider end in the direction of the perineum to substantially seal thereagainst. The insert is covered in a thin hosiery material (omitted for clarity) to ensure a comfortable fit against the body.

Referring to FIGS. 16*a* to 16*e* a back, top, left, bottom and front views of an alternative insert 174 for an underwear garment are shown. The insert 174 is constructed of the same materials as the insert of FIGS. 15*a* to 15*e* but differs in shape and application. Insert 174 has a cupped shape with a slight hollow 176 one side thereof intended, in use, to be the side facing the crotch region. The insert 174 thins towards its front edge 178 where it is more rounded and its sides 180 have a slightly concave shape so as to follow closely the tops of the thighs. When used in female undergarments this insert would cover the genitalia and when used in male undergarments this insert would seal over the perineum.

Referring to FIGS. 17*a* and 17*b* a combined insert 182 is shown that is formed of one insert 162 substantially as described in relation to FIGS. 15*a* to 15*e* and a second insert 174 substantially as described in relation to FIGS. 16*a* to 16*e*. The inserts 174 has a piece of flexible fabric 184, which may comprise activated carbon fibres, extending therefrom and having a first part 186 of a hook and loop type fastener, for example Velcro (®) attached to. The insert 162 has attached thereto the second part 188 of the hook and loop type fastener such that the two inserts 162 174 can be attached to one another as depicted. The inserts overlap slightly and the flexible fabric 184 allows the inserts 162, 174 to pivot relative to one another such that the combined insert 182 can easily fit to different sized bodies.

Referring to FIG. 18*a* an underwear garment 190 is shown having a pouch 192 in the gusset region which has an opening 194 therein and into which an insert 174 (as described above) can be inserted. The pouch 192 is made of two overlapping pieces of fabric attached along their edges. A first piece of a hook and loop type fastener 196 may be located in the pouch 192 and a second part may be located on the insert 174 (not shown) so as to maintain the insert in the correct position within the pouch 192. The underwear garment contains a back panel 198 made of a knitted activated carbon fabric and apart from the additional pouch for receiving the insert is constructed as described with reference to FIGS. 1 to 5. The insert 174 and underwear garment 190 work as described above to filter undesirable odours produced by the wearer of the garment.

Referring to FIG. 18*b* an alternative underwear garment 200 is shown having a similar pouch 202 therein, the pouch 202 extending substantially up the rear centre line of the garment and terminating at an opening 206 towards the waist band 204. A removable insert 162 is located within the pouch 202 such that, in use, the insert 164 located in the gluteal cleft. The underwear garment contains a back panel 208 made of a knitted activated carbon fabric and apart from the additional pouch 202 for receiving the insert is constructed as described with reference to FIGS. 1 to 5. The garment may also have Velcro retaining means to retain the insert 162 in position during use. The insert 164 and underwear garment work as described above to filter undesirable odours produced by the wearer of the garment.

Referring to FIGS. 19*a* and 19*b*, these garments are the same as those described in relation to FIGS. 18*a* and 18*b* except in so far as that, instead of having pouches in which removable inserts can be placed, the inserts are sown into the underwear garments themselves.

Referring to FIG. 20*a* an underwear garment 210 is shown that is a combination of FIGS. 18*a* and 18*b* and which is therefore adapted to removably receive a combined insert 184 therein other features, including the pouch 212 and the opening 214 are provided. The pouch 214 in this instance extends from the opening towards the waistband 204 of the garment through to the gusset region. FIG. 20*b* shows an alternative to FIG. 20 a in which the insert 184 is sewn into the undergarment 216. The undergarment has a knitted activated carbon fabric panel extending from the rear section 218 through the gusset region 220.

Referring to FIG. 21 a pair of hygiene underwear 222 for women is shown. The underwear are substantially the same as the underwear described in relation to FIGS. 1 and 2 except in so far as the activated carbon fabric 224 only extends through the gusset region and the back panel 226 is of a normal fabric.

Any of the activated carbon material used in the underwear garments or inserts may have antibacterial properties as described herein.

The invention claimed is:

1. An article of clothing comprising:

a first portion shaped to cover part of a wearer's buttock region during use and extending into a gusset region of the article and terminates at a seam proximate to a narrowest portion of the gusset region, and a second portion shaped to extend around a wearer's body so as to hold the article against the wearer during use;

wherein said first portion comprises a filter layer sandwiched between opposing backing layers, said filter layer comprising a knitted material comprising activated carbon, said second portion comprises one or more textile panels adjacent said first portion and having an elasticity greater than the elasticity of said first portion such that said second portion conforms to the shape of the wearer's body, and said first portion is smaller in width than a gusset of said article as it passes therethrough such that said first portion is bounded on either side thereof by said second portion in a region of said gusset, wherein said first portion passes from a waist band down a rear portion of said article such that said first portion passes over a part of wearer's buttock region spanning from a first first portion edge at a mid portion of one buttock to a second first portion edge at a mid portion of an opposing buttock and extends through said gusset region of said article such that said first portion terminates on a front side of said article, wherein said filter layer and said opposing backing layers begin at a location above the buttocks such that said filter layer and said opposing backing layers cover the crevice between the wearer's buttocks and subsequently extends forward of the wearer's anus, and wherein said backing layers of said first portion and said second portion comprise the same material.

2. An article of clothing according to claim 1, wherein said second portion is of shape and elasticity to conform to the shape of a user's buttocks and crotch region so as to maintain close contact with a user's body around the perimeter of said first portion.

3. An article of clothing according to claim 1, wherein said first portion is stitched to said second portion about the perimeter of said first portion.

4. An article of clothing according to claim 1, wherein said carbon textile layer comprises 80% or more activated carbon.

5. An article of clothing according to claim 1, wherein said carbon textile layer comprises 100% activated carbon.

6. An article of clothing according to claim 1, wherein said carbon textile is heat treated to provide controlled porosity of the fabric fibers which achieves a high surface area of active carbon whilst retaining material stretch and mechanical performance.

7. An article of clothing according to claim 1, wherein said carbon textile is formed of jersey knit carbon fibers.

8. An article of clothing according to claim 1, wherein said filter layer comprises fabric having anti-bacterial properties.

9. An article of clothing according to claim 8, wherein said knitted carbon material includes yarn having anti bacterial properties.

10. An article of clothing according to claim 9, wherein said yarn having anti bacterial properties is silver or copper yarn.

11. An article of clothing according to claim 8, wherein said knitted carbon material is impregnated with an antibacterial substance.

12. An article of clothing according to claim 1, wherein said filter layer comprises a layered material a knitted activated carbon layer with one or more adhesively bonded backing layers.

13. An article of clothing according to claim 1, wherein the said same material comprises a jersey knit.

14. An article of clothing according to claim 1, wherein said article of clothing is provided with leg openings, and each said leg opening is provided with a resilient edging around each said leg opening.

15. An article of clothing according to claim 1, wherein a seam extends along opposing edges of said first portion so as to run down a mid section of a wearer's buttocks and said seams provide assistance in sealing the perimeter of said first portion against a wearer's skin so as to inhibit escape of gasses around said first portion.

* * * * *